US006453525B1

(12) United States Patent
Liu

(10) Patent No.: US 6,453,525 B1
(45) Date of Patent: Sep. 24, 2002

(54) DOUBLE-BOW SHOE LACE DEVICE

(76) Inventor: Kun-Chung Liu, No. 5, Alley 9, Lane 212, San-Feng Rd., Hou-Li Hsiang, Taichung Hsien (TW)

( * ) Notice: Subject to any disclaimer, the term of this patent is extended or adjusted under 35 U.S.C. 154(b) by 0 days.

(21) Appl. No.: 09/920,857

(22) Filed: Aug. 3, 2001

(51) Int. Cl.[7] ..... A43C 7/00
(52) U.S. Cl. ..... 24/712.5; 24/115 G
(58) Field of Search ..... 24/712–712.9, 24/115 G; 36/50.1

(56) References Cited

U.S. PATENT DOCUMENTS 2,869,204 A * 1/1959 Mopps
3,103,725 A * 9/1963 Robb et al.
4,112,551 A * 9/1978 Sales
4,393,550 A * 7/1983 Yang et al.
5,065,482 A * 11/1991 Lofy
5,293,675 A * 3/1994 Shai
5,335,400 A * 8/1994 Sales

FOREIGN PATENT DOCUMENTS

JP 10-225306 * 8/1998

* cited by examiner

*Primary Examiner*—James R. Brittain
(74) *Attorney, Agent, or Firm*—Foley & Lardner

(57) ABSTRACT

A double-bow shoe lace device for a shoe includes a shoe lace, a clamp member, and a positioning unit. The shoe lace has first, second and third lace portions. The lower ends of the first and second lace portions are anchored on the eyelet tabs. The upper ends of the first and third lace portions are tied together to form a knot and a pair of distal lace segments. The clamp member is sleeved slidably on a medial section of the first lace portion. The lower end of the third lace portion and the upper end of the second lace portion are anchored on the clamp member. The positioning unit positions the knot on the clamp member such that the medial section of the first lace portion and the third lace portion form first and second loops between the knot and the clamp member.

10 Claims, 10 Drawing Sheets

DOUBLE-BOW SHOE LACE DEVICE

BACKGROUND OF THE INVENTION

1. Field of the Invention

The invention relates to a shoe lace device, more particularly to a double-bow shoe lace device for a shoe.

2. Description of the Related Art

Referring to FIG. 1, a conventional shoe lace device 1 of a shoe 4 includes a shoe lace 2 having first and second lace sections 201, 202, and a clamp member 3. The first lace section 201 is strung on a shoe body 41 so as to form a criss-cross pattern on eyelet tabs 5 of the shoe body 41. The second lace section 202 is formed as a simple loop, and has lower ends 2021 connected to the first lace section 201, thereby anchoring the lower ends 2021 on the eyelet tabs 5, respectively. The clamp member 3, as shown in FIG. 2, includes an elongate casing 301, a clamping block 302, and a spring member 303. The elongate casing 301 is formed with a lateral open end 3010 for receiving the clamping block 302, a closed end 3011 opposite to the open end 3010, and a vertically extending hole unit 301' for extension of the lower ends 2021 of the second lace section 202 therethrough. The clamping block 302 is slidably received in the open end 3010 of the casing 301, and is formed with a vertically extending slot unit 3021 that corresponds to the hole unit 301' of the casing 301 for extension of the lower ends 2021 of the second lace section 202 therethrough. The spring member 303 is disposed in the casing 301, and has opposite ends that abut respectively against the clamping block 302 and the closed end 3011 of the casing 301. As such, the clamping block 302 is biased by the spring member 303 so as to misalign the slot unit 3021 from the hole unit 301' in order to clamp the second lace section 202 between the clamping block 302 and the casing 301.

To tighten the shoe 4, the clamp member 3 is forced to move downwardly along the second lace section 202, thereby bringing the lower ends 2021 of the second lace section 202 closer together.

To loosen the shoe 4, the clamping block 302 is operated to align the slot unit 3021 with the hole unit 301' against action of the spring member 303, and the clamp member 3 is then moved upwardly along the second lace section 202, thus permitting the lower ends 2021 of the second lace section 202 to move away from each.

Although the aforesaid shoe lace device 1 is easy to use, the simple loop configuration of the second lace section 202 has an unattractive appearance.

SUMMARY OF THE INVENTION

Therefore, the main object of the present invention is to provide a double-bow shoe lace device for a shoe.

Accordingly, a double-bow shoe lace device of this invention is adapted for use with a shoe having a pair of eyelet tabs and a tongue between the eyelet tabs. The shoe lace device comprises a shoe lace, a clamp member, and a positioning unit. The shoe lace has first, second and third lace portions, each of which has a lower end and an upper end. The lower ends of the first and second lace portions are adapted to be anchored on a respective one of the eyelet tabs. The upper ends of the first and third lace portions are tied together to form a knot and a pair of distal lace segments that extend from the knot. The clamp member is sleeved slidably on a medial section of the first lace portion between the lower and upper ends of the first lace portion. The lower end of the third lace portion and the upper end of the second lace portion are anchored on the clamp member. The positioning unit is connected to the knot and the clamp member, and positions the knot on the clamp member such that the medial section of the first lace portion and the third lace portion form first and second loops between the knot and the clamp member.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
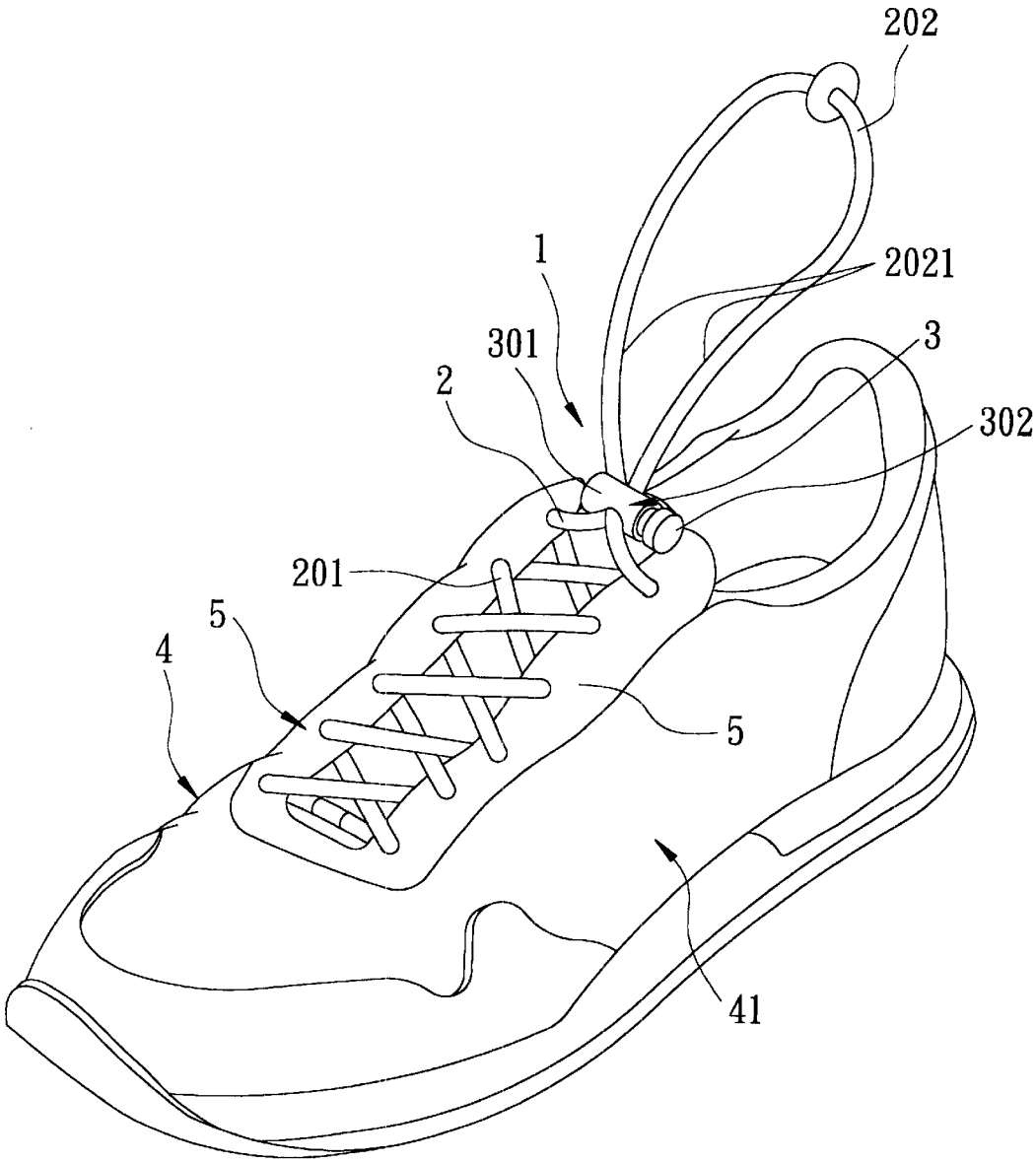
FIG. 1 PRIOR ART
FIG. 1 is a perspective view of a shoe with a conventional shoe lace device.
Figure 2:
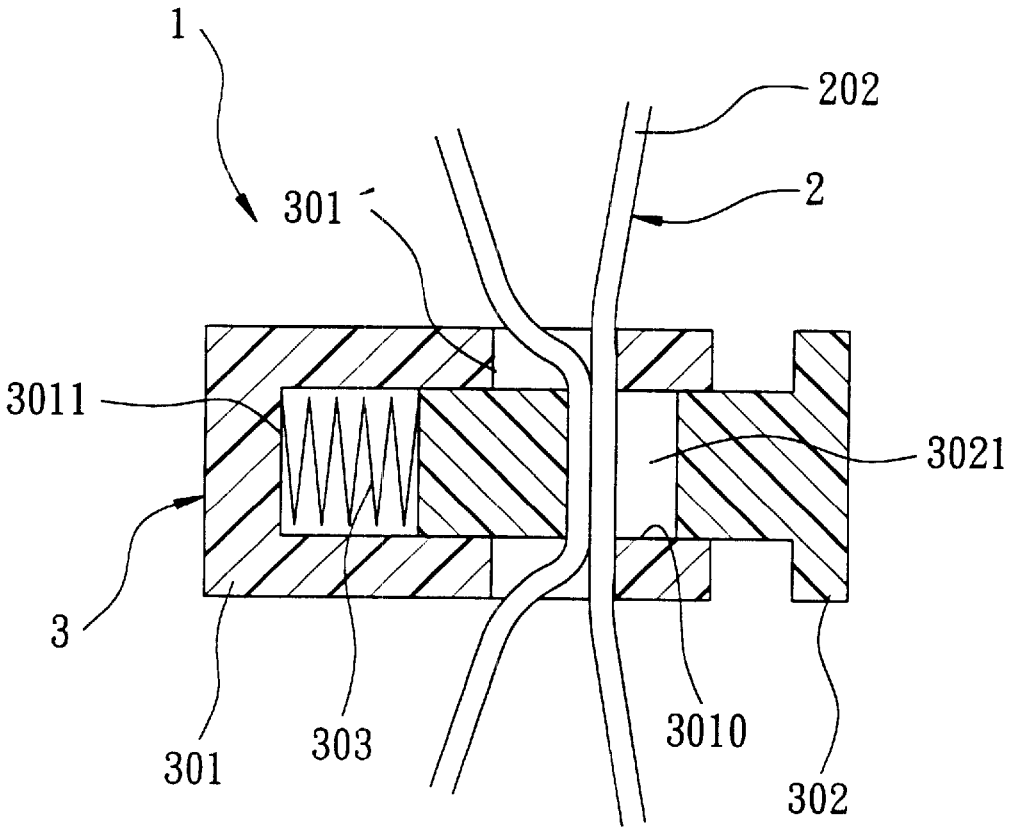
FIG. 2 PRIOR ART
FIG. 2 is a cross-sectional view of a clamp member of the conventional shoe lace device.

Before the present invention is described in greater detail, it should be noted that like elements are denoted by the same reference numerals throughout the disclosure.

Figure 3:
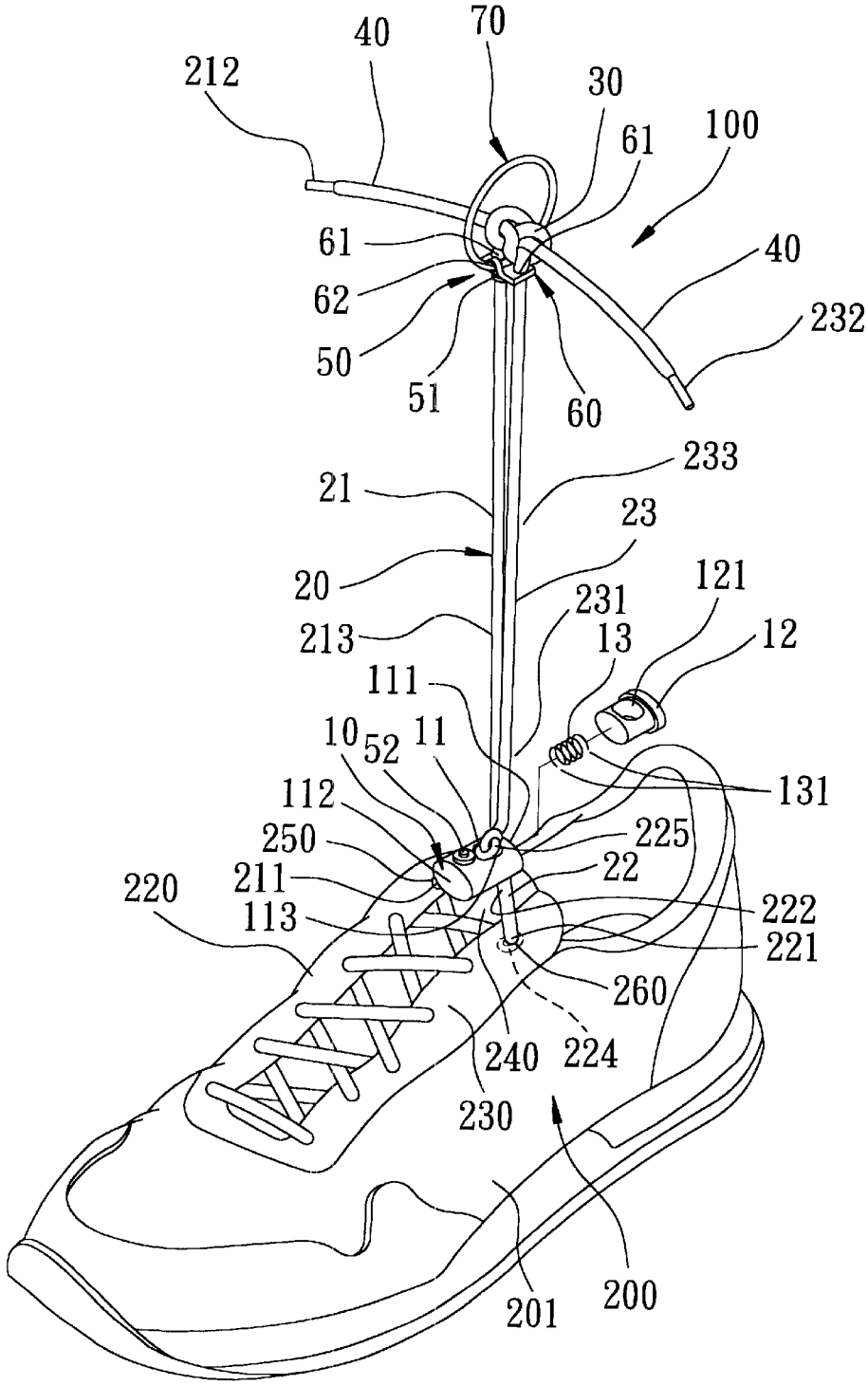
FIG. 3 is a perspective view of a shoe that incorporates the first preferred embodiment of a double-bow shoe lace device according to the present invention.
Figure 4:
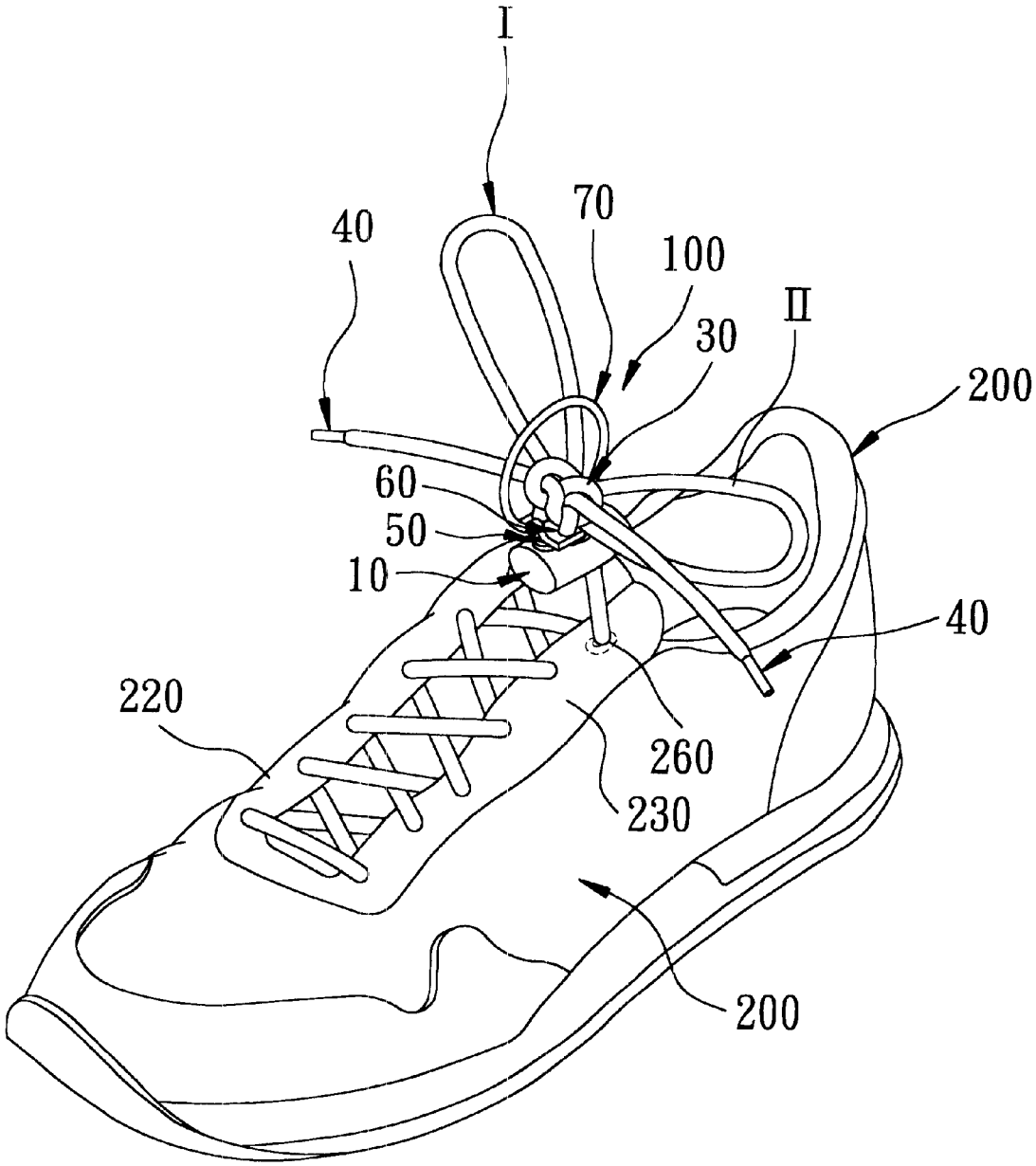
FIG. 4 is a perspective view showing the shoe with the double-bow shoe lace device of the first preferred embodiment in a tightened state.
Figure 5:
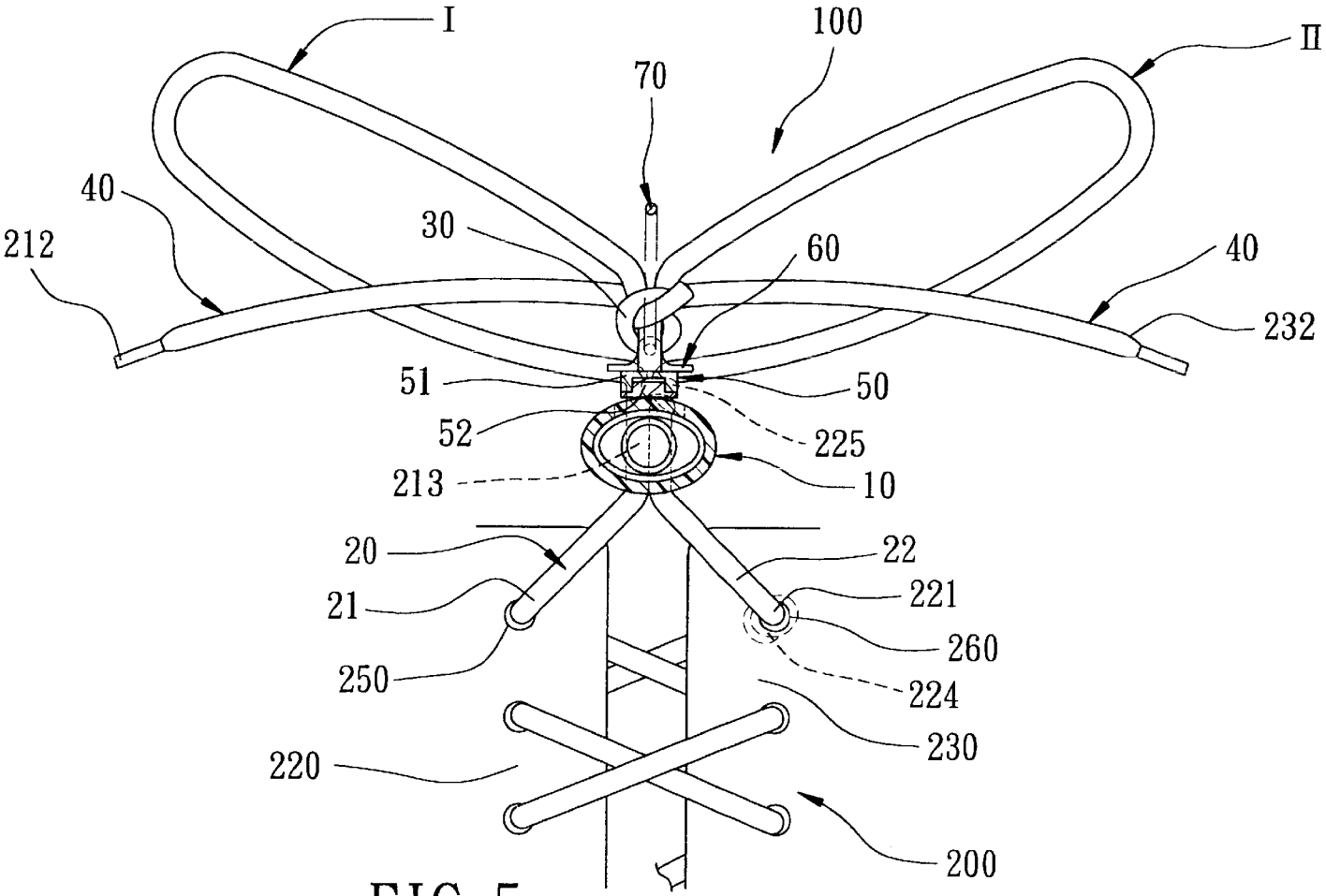
FIG. 5 is a fragmentary cross-sectional view showing how the shoe can be tightened by the shoe lace device of the first preferred embodiment.

Referring to FIGS. 3, 4 and 5, the first preferred embodiment of a double-bow shoe lace device 100 according to the present invention is shown to be adapted for use with a shoe 200 having a pair of eyelet tabs 220, 230 and a tongue 240 between the eyelet tabs 220, 230. The shoe lace device 100 comprises a shoe lace 20, a clamp member 10, a positioning unit 50, a guide plate 60, and He a pull ring 70. The shoe lace 20 has a first lace segment that is strung on a shoe body 201 in a conventional manner so as to form a criss-cross pattern on the eyelet tabs 220, 230, and a second lace segment that includes first, second and third lace portions 21, 22, 23. Each of the lace portions 21, 22, 23 has a lower end 211, 221, 231 and an upper end 212, 222, 232. The lower end 211 of the first lace portion 21 is connected to the first lace segment, and is adapted to be anchored on a first eyelet 250 of the first eyelet tab 220. The lower end 221 of the second lace portion 22 is formed with a knot 224 that is connected to the first lace segment, and that is adapted to engage a first eyelet 260 of the second eyelet tab 230, thereby anchoring the lower end 221 on the second eyelet tab 230. The upper end 222 of the second lace portion 22 passes through the clamp member 10, and is formed with a knot 225 that is disposed externally of the clamp member 10, thereby anchoring the upper end 222 of the second lace portion 22 on the clamp member 10. The knots 224, 225 on the lower and upper ends 221, 222 of the second lace section 22 cooperate to limit a maximum distance of the clamp member 10 from the second eyelet tab 230. The lower end 231 of the third lace portion 23 is connected to the upper end 222 of the second lace portion 22, thereby anchoring the same on the clamp member 10. The upper ends 212, 232 of the first and third lace portions 21, 23 are tied together to form a knot 30 and a pair of distal lace segments 40 that extend from the knot 30.

The clamp member 10 is sleeved slidably on a medial section 213 of the first lace portion 21 between the lower and upper ends 211, 212 of the first lace portion 21, and includes an elongate casing 11, a clamping block 12, and a first biasing member 13. The elongate casing 11 has an open lateral side 111, and a closed end portion 112 opposite to the open lateral side 111, and is formed with a hole unit 113 that permits extension of the medial section 213 of the first lace portion 21 therethrough. The clamping block 12 is slidably received in the casing 11, and is formed with a groove unit 121 that corresponds to the hole unit 113 of the casing 11 for extension of the medial section 213 of the first lace portion 21. The first biasing member 13, in the form of a coil spring, is disposed in the casing 11, has opposite ends 131 that abut respectively against the clamping block 12 and the closed end portion 112 of the casing 11, and biases the clamping block 12 toward the open lateral side 111 of the casing 11, thereby clamping the medial section 213 of the first lace portion 21 between the clamping block 12 and the casing 11.

The positioning unit 50 is connected to the knot 30 and the clamp member 10, and positions the knot 30 on the clamp member 10 such that the medial sections 213, 233 of the first and third lace portions 21, 23 form first and second loops (I), (II) between the knot 30 and the clamp member 10, as best illustrated in FIGS. 4 and 5. In this embodiment, the positioning unit 50 includes a male fastener 52 and a female fastener 51. The male fastener 52 is secured on the casing 11 of the clamp member 10. The female fastener 51 is secured on the bottom side of the guide plate 60 to engage removably the male fastener 52. Preferably, one of the male and female fasteners 52, 51 is magnetic, whereas the other of the male and female fasteners 52, 51 is magnetically attractive.

The guide plate 60 is formed with a pair of retaining holes 62 (only one is visible), and a pair of lace holes 61 to permit the upper ends 212, 232 of the first and third lace portions 21, 23 to extend fittingly therethrough such that the guide plate 60 is disposed between the knot 30 and the clamp member 10.

The pull ring 70 extends through the retaining holes 62 of the guide plate 60, and is disposed between the knot 30 and the guide plate 60.

Figure 7:
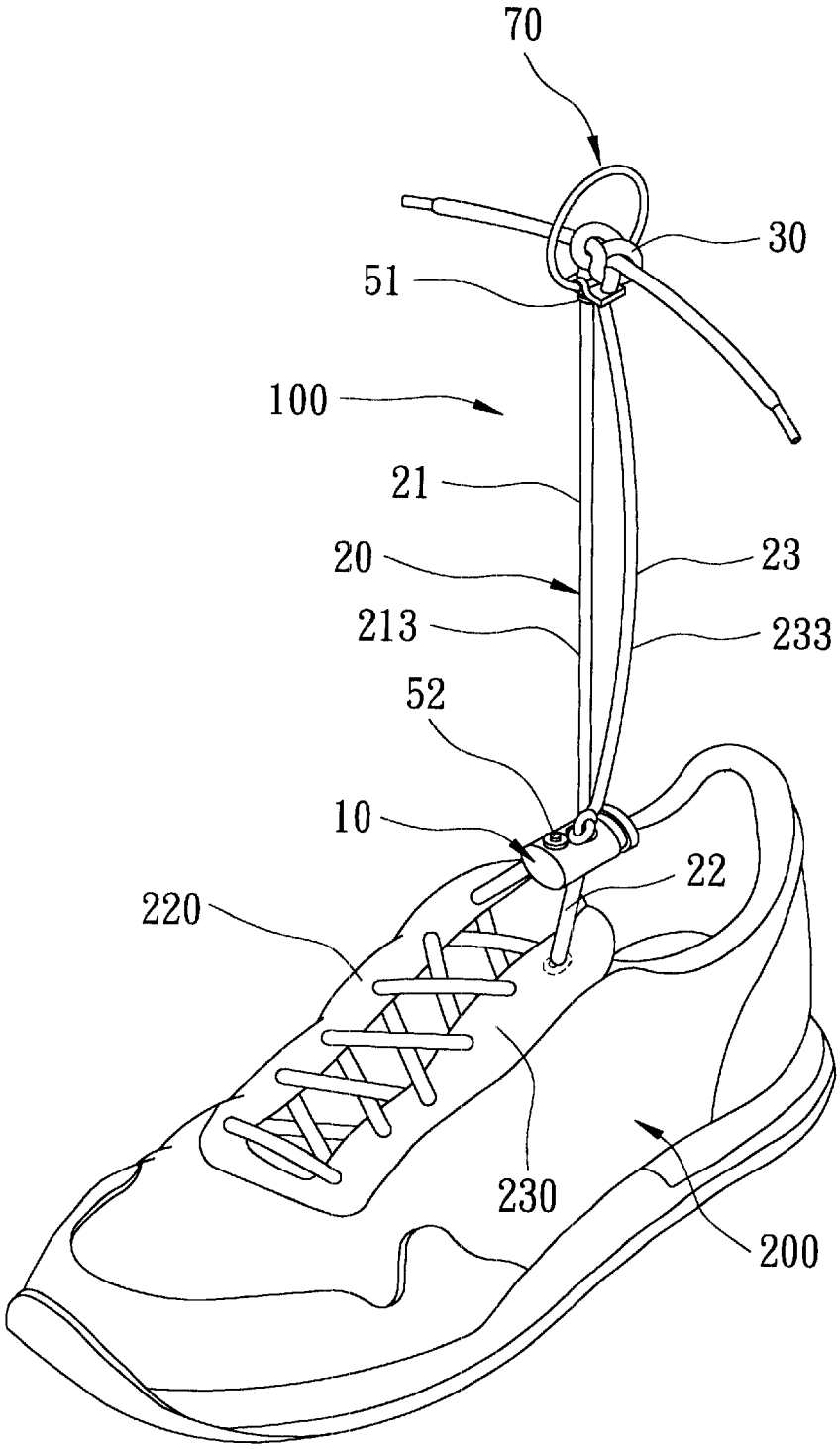
FIG. 7 is a perspective view showing how the shoe is tightened by pulling a pull ring of the first preferred embodiment.

In use, when the pull ring 70 is pulled upwardly, the clamp member 10 will be urged to slide downwardly along the medial section 213 of the first lace portion 21 to bring the lower ends 211, 221 of the first and second lace portions 21, 22 and thus the first and second eyelet tabs 220, 230 closer together for tightening the shoe 200. After the shoe 200 is tightened, the pull ring 70 is then brought close to the clamp member 10 for inter-engaging the fasteners 51, 52 of the positioning unit 50. The first and second loops (I), (II) of the medial sections 213, 233 of the first and third lace portions 21, 23 and the distal lace ends 40 of the knot 30 cooperate to form a double-bow configuration, as best illustrated in FIGS. 4, 5, and 7.

Figure 6:
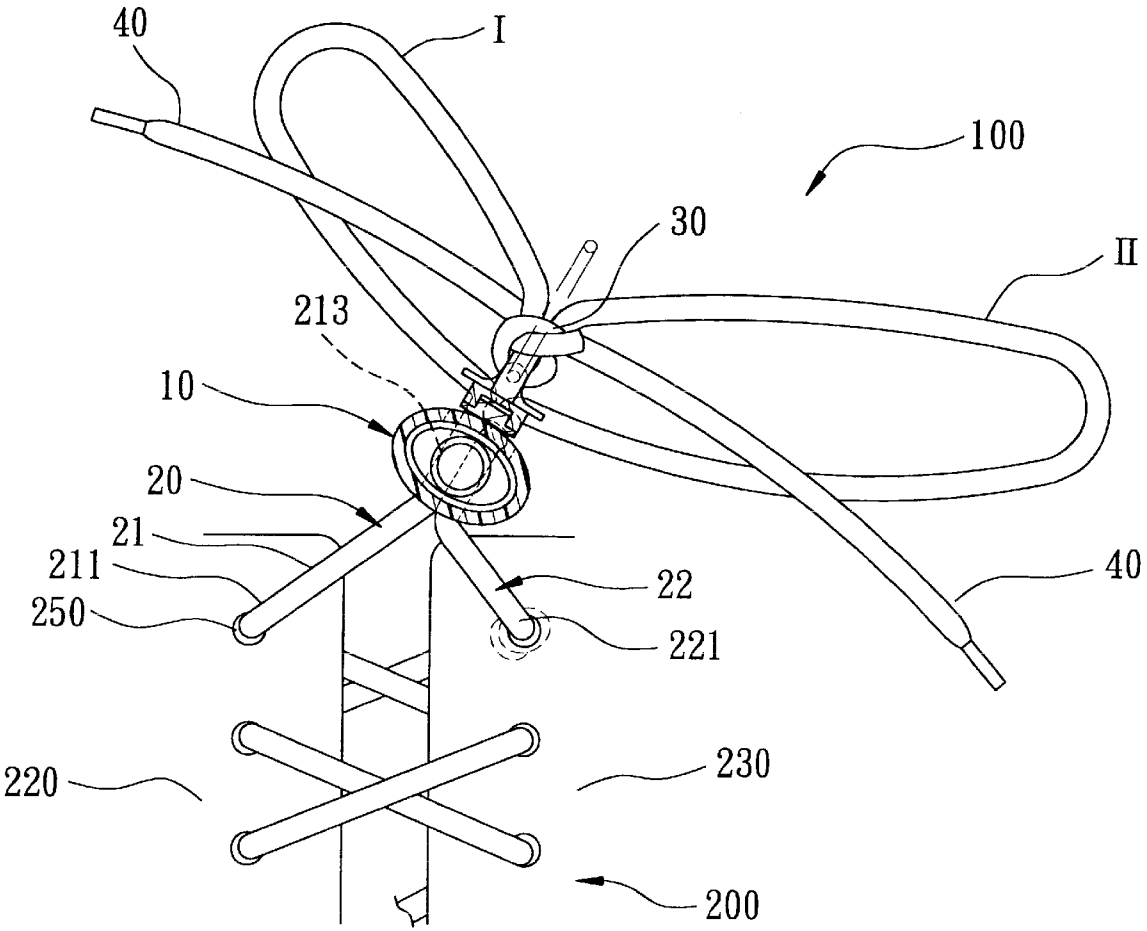
FIG. 6 is a fragmentary cross-sectional view illustrating how movement of a clamp member of the shoe lace device of the first preferred embodiment permits the loosening of the shoe.

To loosen the shoe 200, the clamping block 12 is operated to compress the biasing member 13, thereby aligning the groove unit 121 with the hole unit 113. At this time, the clamp member 10 can be slid upwardly along the medial portion 213 of the first lace portion 21, thereby permitting the lower ends 211, 221 of the first and second lace portions 21, 22 to move away from each other for loosening the shoe 200, as best illustrated in FIG. 6.

Therefore, the shoe 200 is not only easy to wear and remove, but also has an attractive appearance in view of the double-bow configuration of the shoe lace device 100.

Figure 8:
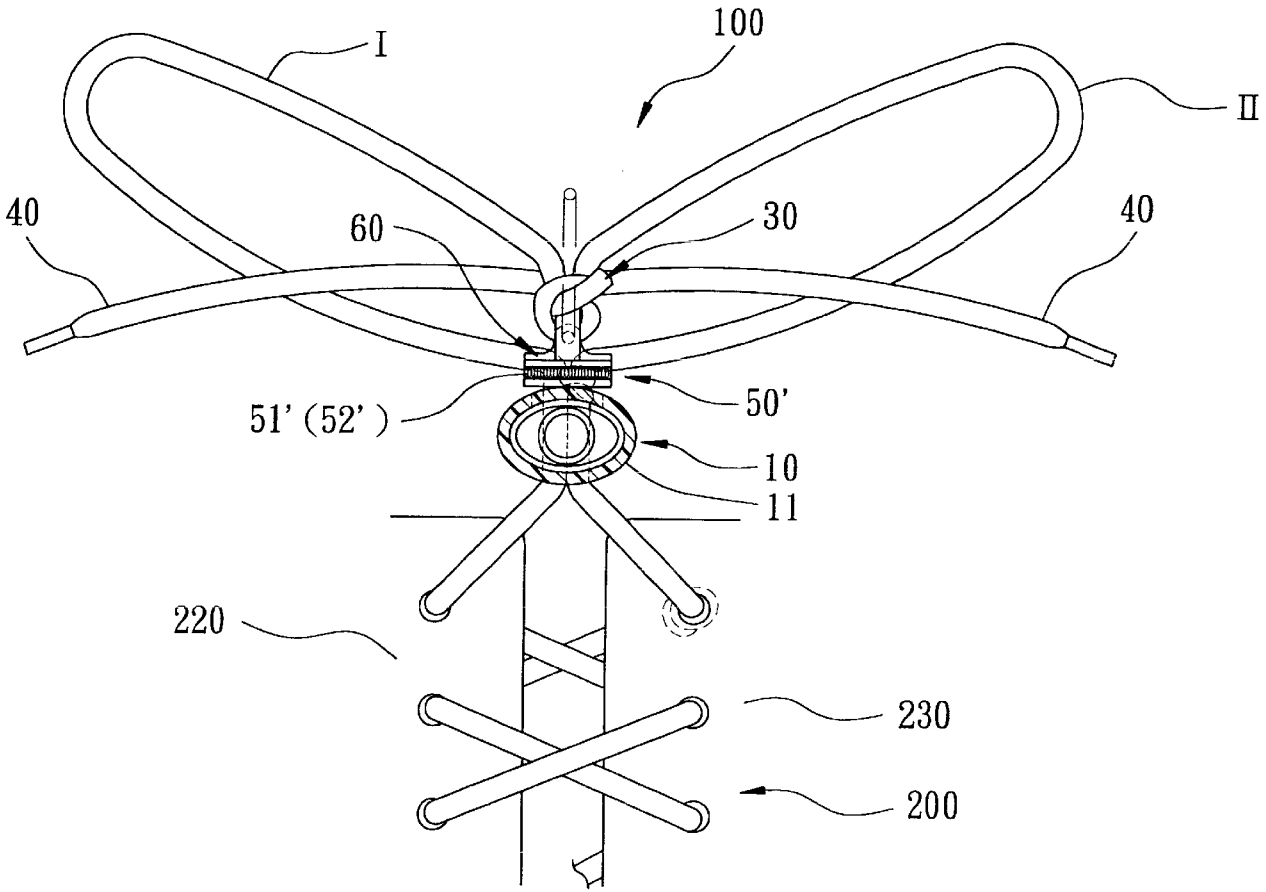
FIG. 8 is a fragmentary cross-sectional view showing a shoe that incorporates the second preferred embodiment of a shoe lace device according to the present invention.

Referring to FIG. 8, the second preferred embodiment of a double-bow shoe lace device 100 according to the present invention is shown to be substantially similar to the first preferred embodiment. Unlike the first preferred embodiment, the positioning unit 50' includes a hook fastener 52' and a loop fastener 51'. The hook fastener 52' is secured on the bottom side of the guide plate 60. The loop fastener 51' is secured on the casing 11 of the clamp member 10 and engages removably the hook fastener 52'.

The second preferred embodiment operates in a manner substantially similar to that of the first preferred embodiment.

Figure 9:
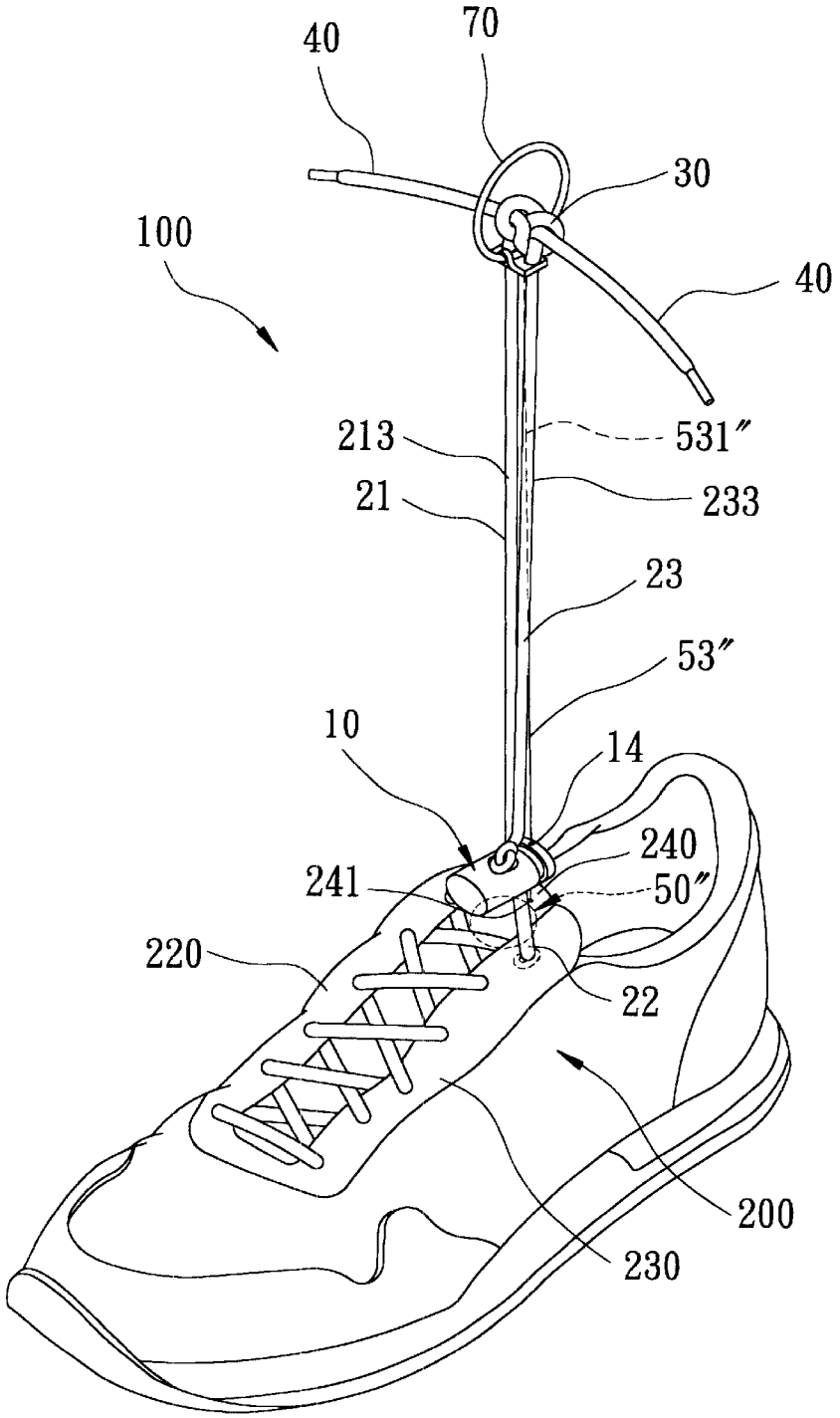
FIG. 9 is a perspective view of a shoe that incorporates the third preferred embodiment of a double-bow shoe lace device according to the present invention.
Figure 10:
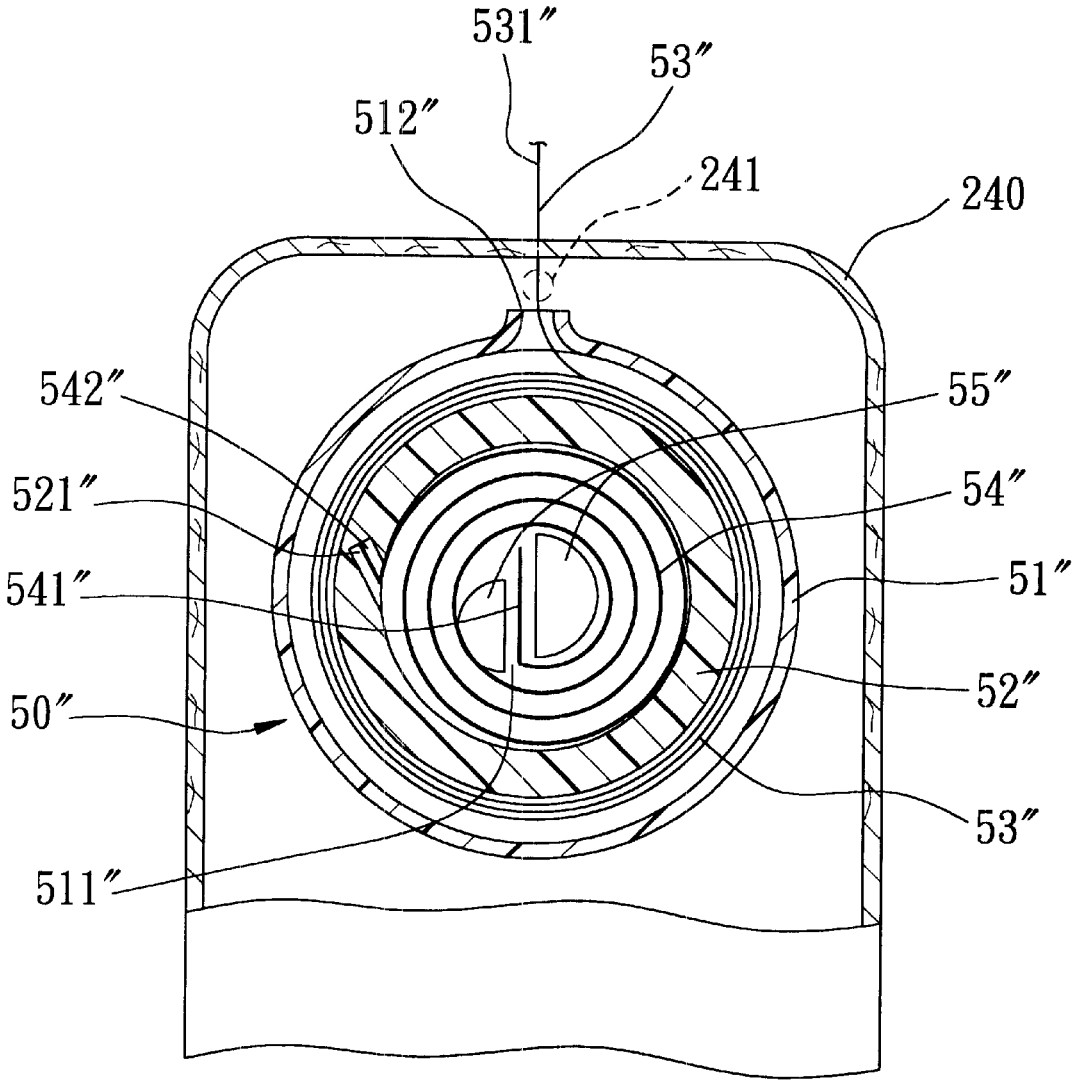
FIG. 10 is a schematic sectional view of a positioning unit of the shoe lace device of FIG. 9.

Referring to in FIGS. 9 and 10, the third preferred embodiment of a double-bow shoe lace device 100 according to the present invention is shown to be substantially similar to the first and second preferred embodiments. However, in this embodiment, the positioning unit 50" is adapted to be embedded in the tongue 240 of the shoe 200, and includes a frame 51", a rotatable reel member 52", a pull string 53", and a second biasing member 54". The frame 51" has two upright posts 55" that define a groove 511" therebetween, and a channel 512". The reel member 52" has an inner groove 521", and is mounted rotatably in the frame 51". The pull string 53" is wound on the reel member 52", and has a distal section 531". The distal section 531" passes through the channel 512" of the frame 51", through a slot unit 241 of the tongue 240, a string hole 14 of the clamp member 10, and extends upwardly to connect with the knot 30. The second biasing member 54" biases the reel member 52" so as to wind the pull string 53" on the reel member 52", thereby pulling the knot 30 toward the clamp member 10. In this embodiment, the second biasing member 54" is a spiral spring having an innermost end 541" inserted into the groove 511" of the frame 51" and an outermost end 542" connected to the inner groove 521" of the reel member 52".

In use, by pulling the pull ring 70 upwardly, the distal section 531" of the pull string 53" is pulled out of the positioning unit 50", thereby winding the second biasing member 54". At this time, the clamp member 10 is forced to move downwardly along the medial section 213 of the first lace portion 21, thereby bringing the lower sections 211, 221 of the first and second lace portions 21, 22 and thus the first and second eyelet tabs 220, 230 closer together for tightening the shoe 200. After the shoe 200 is tightened, the pull ring 70 is released, and the biasing action of the second biasing member 54" causes the pull string 53" to wind on the reel member 52", thereby pulling the knot 30 toward the clamp member 10.

Loosening of the shoe 200 that incorporates the third preferred embodiment proceeds in a manner substantially similar to that of the first preferred embodiment.

It should be noted that, during tightening of the shoe 200 that incorporates any of the aforementioned preferred embodiments, the positioning unit is separated from the clamp member so as to allow greater movement of the first lace portion 21. Pulling of the first lace section 21, with the positioning unit 50 separated from or attached to the clamp member 10, will accomplish the same result.

In addition, the eyelets 250, 260 through which the first and second lace portions 21, 22 extend can be formed to be spaced farther apart, so that the length of the second lace portion 22 can be increased, thereby allowing greater movement of the clamp member 10 to facilitate the easy wearing and removal of the shoe 200. Alternatively, a hitch member (not shown) could be used instead of the eyelet 260 to anchor removably the lower end 221 of the second lace portion 22 onto the respective eyelet tab 230 of the shoe 200 to facilitate easy wearing and removal of the shoe 200.

While the present invention has been described in connection with what is considered the most practical invention is not limited to the disclosed embodiments but is intended to cover various arrangements included within the spirit and scope of the broadest interpretation so as to encompass all such modifications and equivalent arrangements.

I claim:

1. A double-bow shoe lace device for a shoe with a pair of eyelet tabs and a tongue between the eyelet tabs, said shoe lace device comprising:

a shoe lace having first, second and third lace portions, each of which has a lower end and an upper end;

said lower ends of said first and second lace portions being adapted to be anchored on a respective one of the eyelet tabs;

said upper ends of said first and third lace portions being tied together to form a knot and a pair of distal lace segments that extend from said knot;

a clamp member sleeved slidably on a medial section of said first lace portion between said lower and upper ends of said first lace portion;

said lower end of said third lace portion and said upper end of said second lace portion being anchored on said clamp member; and a positioning unit, connected to said knot and said clamp member, for positioning said knot on said clamp member such that said medial section of said first lace portion and said third lace portion form first and second loops between said knot and said clamp member.

2. The double-bow shoe lace device of claim 1, wherein said lower end of said second lace portion is formed with a knot that is adapted to engage one of the eyelet tabs of the shoe.

3. The double-bow shoe lace device of claim 2, wherein said upper end of said second lace portion passes through said clamp member and is formed with a knot that is disposed externally of said clamp member, thereby anchoring said upper end of said second lace portion on said clamp member, said lower end of said third lace portion being connected to said upper end of said second lace portion.

4. The double-bow shoe lace device of claim 3, wherein said clamp member includes:

an elongate casing having an open lateral side and formed with a hole unit that permits extension of said medial section of said first lace portion therethrough;

a clamping block slidably received in said casing and formed with a groove unit for extension of said medial section of said first lace portion; and a biasing member disposed in said casing and biasing said clamping block toward said open lateral side of said casing, thereby clamping said medial section of said first lace portion between said clamping block and said casing.

5. The double-bow shoe lace device of claim 1, further comprising a guide plate formed with a pair of lace holes to permit said upper ends of said first and third lace portions to extend fittingly therethrough such that said guide plate is disposed between said knot and said clamp member.

6. The double-bow shoe lace device of claim 5, further comprising a pull ring connected to said guide plate.

7. The double-bow shoe lace device of claim 1, wherein said positioning unit includes a male fastener provided on one of said knot and said clamp member, and a female fastener provided on the other of said knot and said clamp member to engage removably said male fastener.

8. The double-bow shoe lace device of claim 7, wherein one of said male and female fasteners is magnetic, and the other of said male and female fasteners is magnetically attractive.

9. The double-bow shoe lace device of claim 1, wherein said positioning unit includes a hook fastener provided on one of said knot and said clamp member, and a loop fastener provided on the other of said knot and said clamp member to engage removably said hook fastener.

10. The double-bow shoe lace device of claim 1, wherein said positioning unit is adapted to be embedded in the tongue of the shoe, and includes:

a rotatable reel member;

a pull string wound on said reel member and having a distal section passing through said clamp member and connected to said knot; and a biasing member for biasing said reel member so as to wind said pull string on said reel member, thereby pulling said knot toward said clamp member.

* * * * *